US005194861A

United States Patent [19]

St. Clair

[11] Patent Number: 5,194,861

[45] Date of Patent: Mar. 16, 1993

[54] ON BOARD TIMER SYSTEM FOR A RACING VEHICLE

[75] Inventor: Raymond E. St. Clair, Huntsville, Ala.

[73] Assignee: Scientific Racing Equipment, Inc., Huntsville, Ala.

[21] Appl. No.: 711,962

[22] Filed: Jun. 7, 1991

Related U.S. Application Data

[63] Continuation-in-part of Ser. No. 482,339, Feb. 20, 1990, abandoned.

[51] Int. Cl.[5] ..... G08B 21/00

[52] U.S. Cl. ..... 340/870.28; 340/323 R; 340/309.15; 340/309.4; 368/8

[58] Field of Search ..... 340/870.28, 323 R, 309.15, 340/309.4, 936, 941, 988; 377/24.1, 16; 368/8, 108, 120, 6

[56] References Cited

U.S. PATENT DOCUMENTS 4,245,334 1/1981 Bieramperl ..... 368/6

4,392,122 7/1983 Hocken ..... 340/323 R

*Primary Examiner*—Donald J. Yusko
*Assistant Examiner*—Michael Krakovsky
*Attorney, Agent, or Firm*—John C. Garvin, Jr.; Harold W. Hilton

[57] ABSTRACT

A system for on-board timing for a vehicle traversing a predetermined course having at least one marker or indicator such as a start/finish line placed on or adjacent the track. A sensor carried on the vehicle senses when the vehicle passes the marker and provides an electrical signal for actuating an on-board timer and display device. A timing circuit is activated as the vehicle passes a predetermined point (marker) the first and subsequent times. The display device displays the time it took to traverse the prior lap while the timing system times and records the time it is taking to traverse the lap being traversed so that this recorded time can be displayed during the following lap. This sequence of operation continues for each of the laps the vehicle traverses.

14 Claims, 10 Drawing Sheets

ON BOARD TIMER SYSTEM FOR A RACING VEHICLE

This application is a continuation-in-part of U.S. Pat. application Ser. No. 07/482,339, filed Feb. 20, 1990 now abandoned.

BACKGROUND OF THE INVENTION

This invention generally relates a system for providing on-board timing of a vehicle traversing a predetermined course. The invention is more particularly directed to an on-board timing device for a race car to indicate the time elapsed between predetermined markers by the race car in response to signals generated when the race car passes a reference marker on or adjacent to the track.

During an automobile race it is important that the driver be instantaneously provided with the time that was required to finish the distance or lap that he has just completed. Typically such timing information is provided by a team member in the pit actuating a hand held stop watch which is manually actuated and manually deactivated as the race car completes the lap. The timing information is then radioed from the pit to the headphone worn by the driver to provide him with the lap timing information. Obviously,the results of such timing procedures are not accurate. The actuating and deactivating of the stop watch and in passing the information on to the driver produces errors.

Some race tracks utilize electronic timers which are triggered by the breaking of a electromagnetic beam which is directed across the track. However, in order to be useful to a driver during a race when many cars break the beam intermittently or continuously, a monitor (typically, a team member) is required to monitor when a specific car breaks the beam and to pass the time information on to the driver through the headphones.

One timing system, disclosed in U.S. Pat. No. 4,857,886 uses a stationary transceiver located at selected locations along the course. A mobile transmitter is located on each vehicle for transmitting a distinctive coded transmission of short time duration. A network controller must be located in the vicinity of the course for receiving transmissions from the transmitting portion of each transceiver.

Another type of timing system is disclosed in U.S. Pat. No. 4,392,122 in which a racing car is equipped with a magneic sensing coil for producing electrical signals in response to detection of magnets disposed in one or more positions along the course. The output of the sensing coil is used to control on-board timing circuitry to enable the average vehicle speed over the course to be determined and displayed. The system requires (for race cars) two timers and two displays which are operated alternately so that at the end of each lap the signal produced by the sensor is used to start one timer and stop the other timer which will have started at the beginning of the lap. A discriminator is required to control alternate operation of the two timers and display units. Applicant uses a single timer and display along with a presettable countdown timer gate circuit,-thus reducing component and system parts cost and also reduces the size and weight of the system while making it easier for the driver to interpret. Without this presettable countdown timer gate circuit the use of an on-board timing system in the racing vehicle is not practical because extraneous markers and other objects on or along the racing track will falsely trigger the timing sequence.

In applicant's system, the single clock is actuated at the start of the lap but delays an indication of useful timing information until the race car has completed the first lap and passed finish line, at which instance the lap time is displayed and the timing of the next lap is initiated and progresses but is not displayed until the finish line is again crossed.

SUMMARY OF THE INVENTION

It is an object of the present invention therefore to provide an on-board timing system for vehicles such as race cars for indicating real time timing information relating to a predetermined distance.

It is another object of the present invention to provide such a timing system for indicating the time elapsed by a racing car on either a circular track, an oval track or a straight-away track.

It is yet another object of the present invention to provide such a timing system with means to simultaneously display the time in which a preceding lap of a race track was completed while internally recording the time of a lap presently being traversed for subsequent display thereof.

DESCRIPTION OF THE PREFERRED EMBODIMENT

Figure 1:
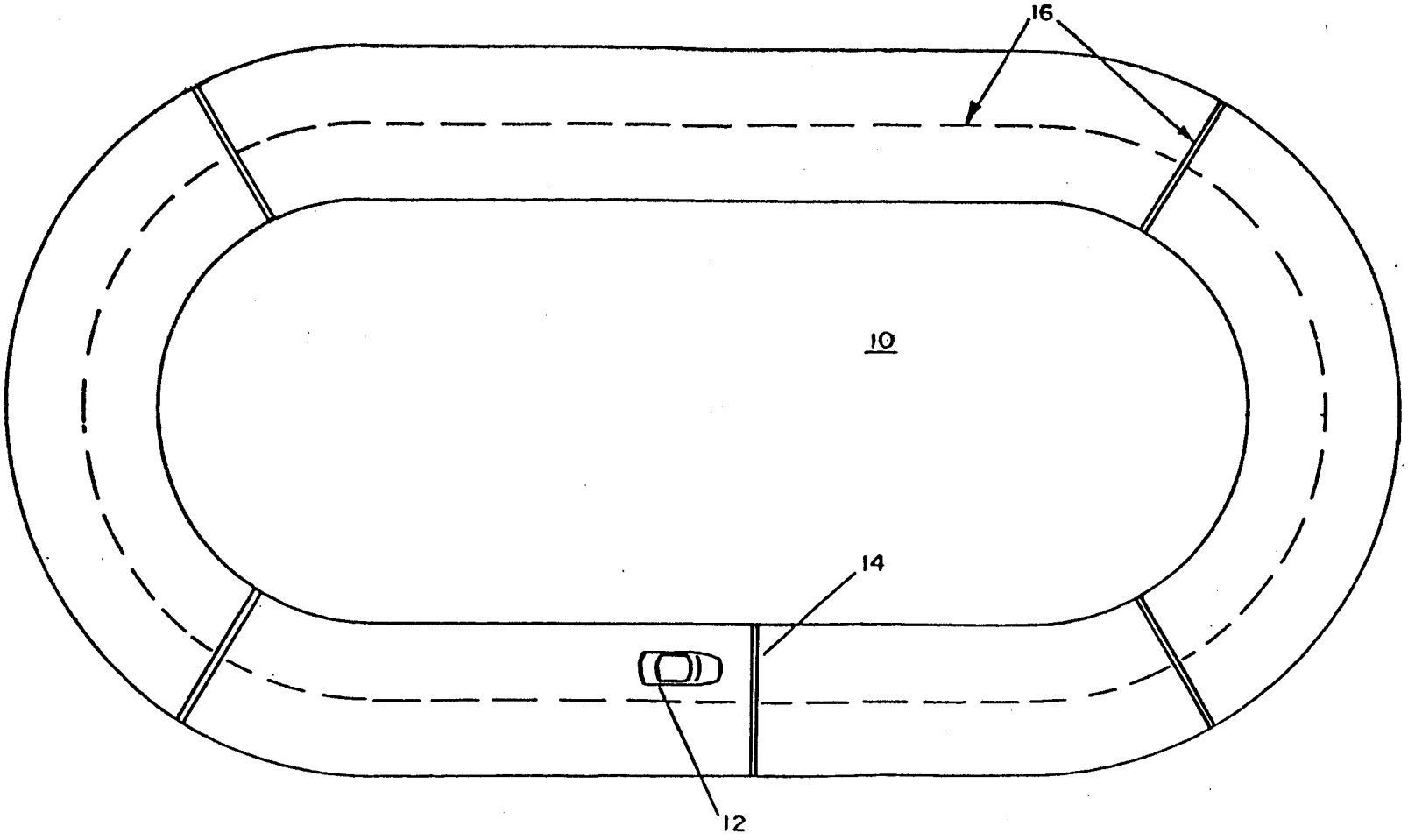
FIG. 1 is a pictorial view of a race car and track embodying the principles of the present invention as used on an oval track.

As seen in FIG. 1, a race track 10 has a race car 12 positioned adjacent the start/finish line 14. Typically the line 14 is painted on the track and other segment lines 16 may be located around the track. These segment lines may be placed on the track as divider lines and may be painted on the track, or, the segment lines may be magnetic strips, metal members or any of many other materials which may be used for timing or scoring a race.

One problem encountered with timing by an on-board sensor on such racetracks is that the sensor cannot discriminate between the different markings (segment lines) on the track. However, applicant's on-board timing system eliminates the need to discriminate between such markings by incorporating a circuit which prevents the sensing system from sensing until after a predetermined time has elapsed. The predetermined time being sufficient to allow the race car to have passed over the extraneous segment markers on the track.

Figure 2:
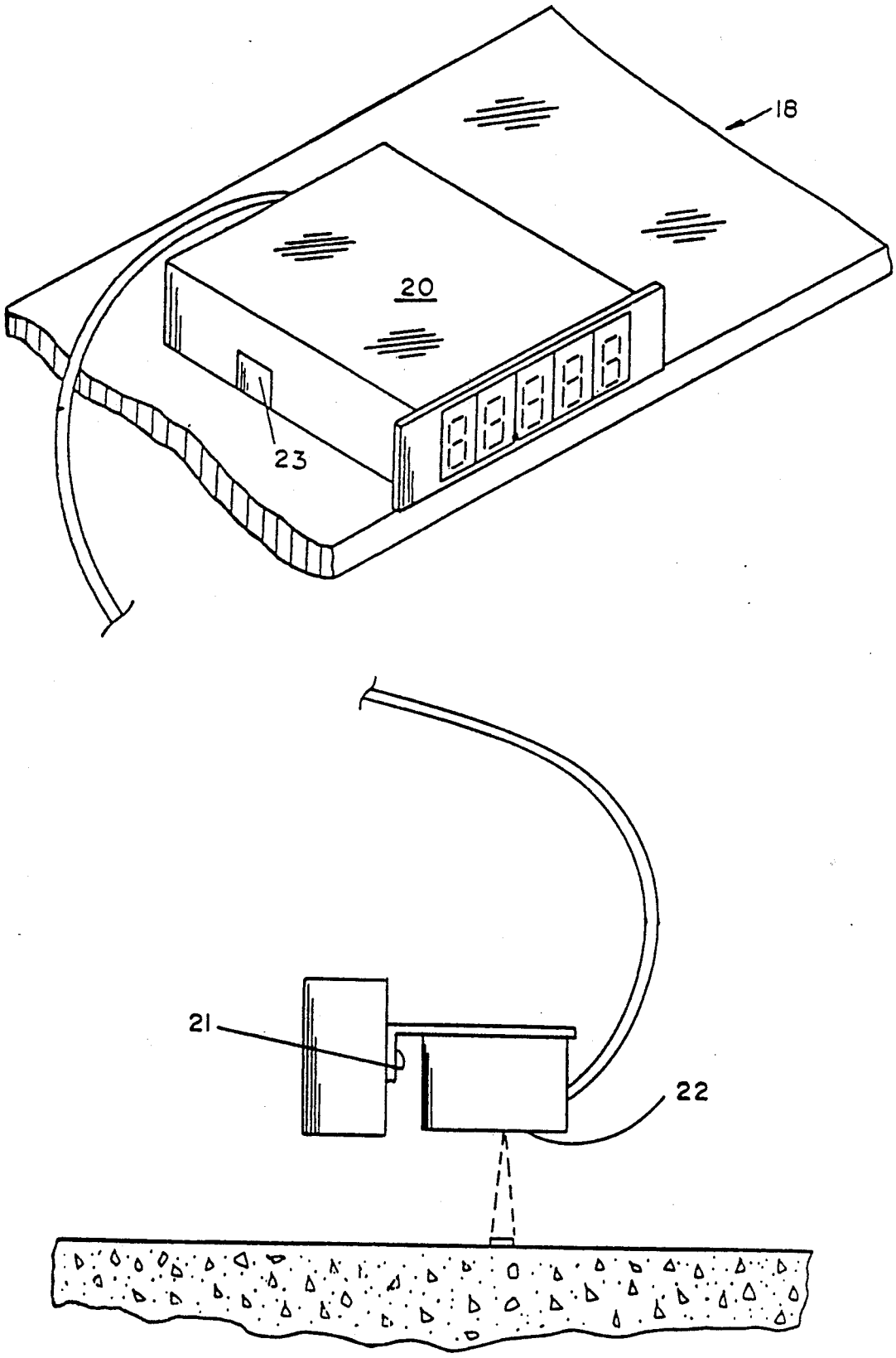
FIG. 2 is a pictorial view of the sensor and read-out device mounted in an automobile.

FIG. 2 illustrates the on-board timing system 18 mounted in the car. A display console housing 20 is shown mounted on the dash board and is electrically connected to a sensor or detector 22 mounted on the frame 21 of the car just above the surface of the race track. The housing is provided with a door 23 to provide access into the interior.

Figure 3:
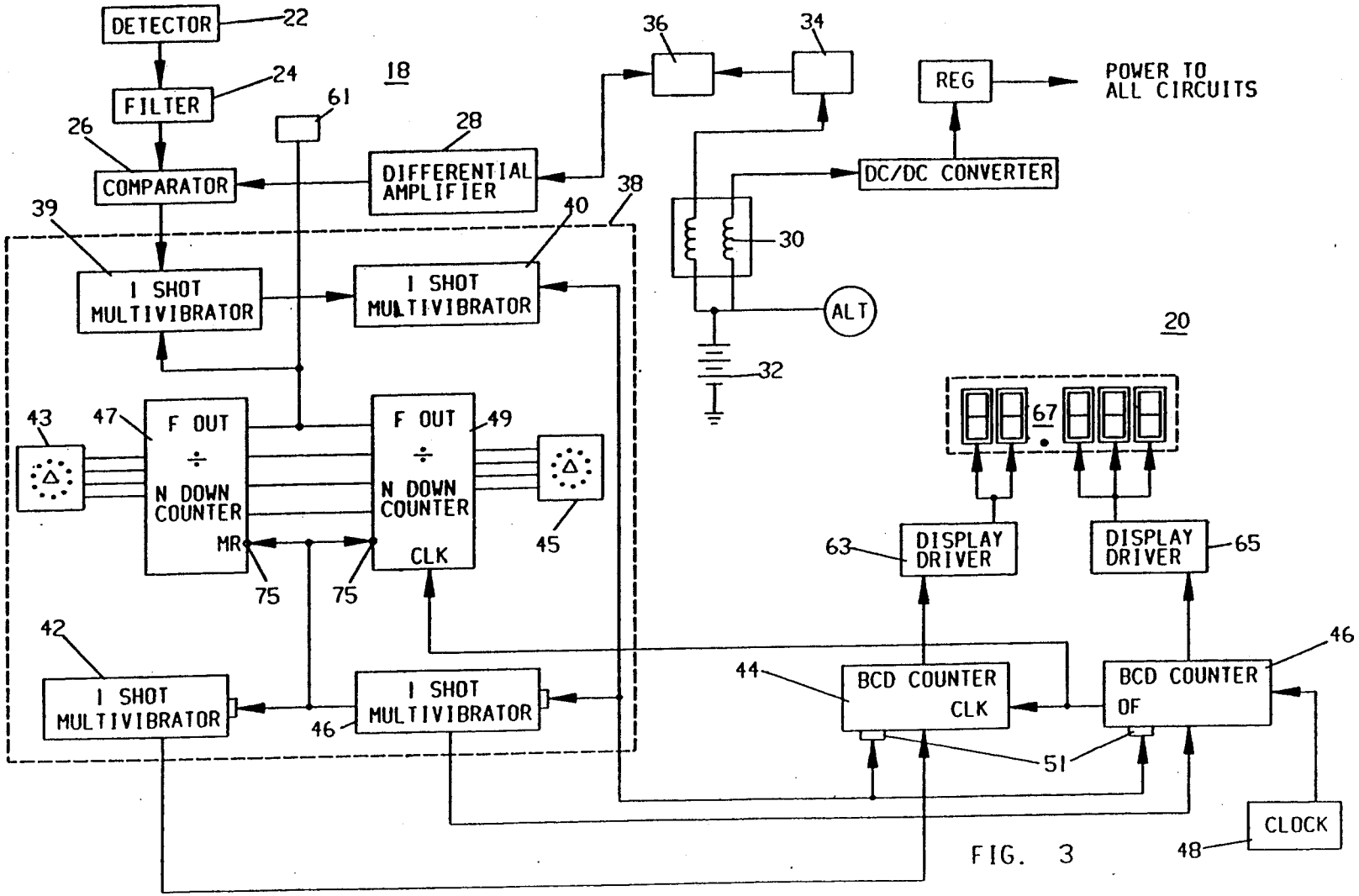
FIG. 3 is a block diagram of the timing and display system of the present invention.

FIG. 3 is a block diagram of the on-board timing system 18 including a detector 22 and a timing/display unit 20. Detector 22 is connected to a power source and to a filter circuit 24 where stimulus from detector 22 is filtered by filter 24 and delivered to a comparator 26 which compares the signal with a DC level. The DC level may be preset, or it may be set by a differential amplifier 28 (as seen in FIG. 3) which derives this DC level by comparing a set DC level from the supply output and the noise from a power input 30 which is connected to battery 32. This signal may be rectified by rectifier 34 and filtered by filter 36. Thus, the sensitivity of comparator 26 goes down as the noise level goes up. This keeps the system from being falsely triggered by electronic noise from the race car.

The output from the detector 22 is sent to a presettable countdown timer gate circuit 38 which includes four one shot multivibrators 39, 40 41 and 42, a pair of BCD switches 43 and 45 and a pair of divide by N down counters countdown timers 47 and 49.

Signals from the presettable countdown timer gate are transmitted to the latch enable inputs 51 of a pair of BCD counters 44 and 46 to initiate the timing procedure.

A clock 48 connected to BCD counter 46, provides very accurate (one thousand cycle square wave) signals to the BCD counter 46 where they are counted internally in the BCD counters. The clock is a commercially available item, such as statek part #PXO-1000.

Figure 5:
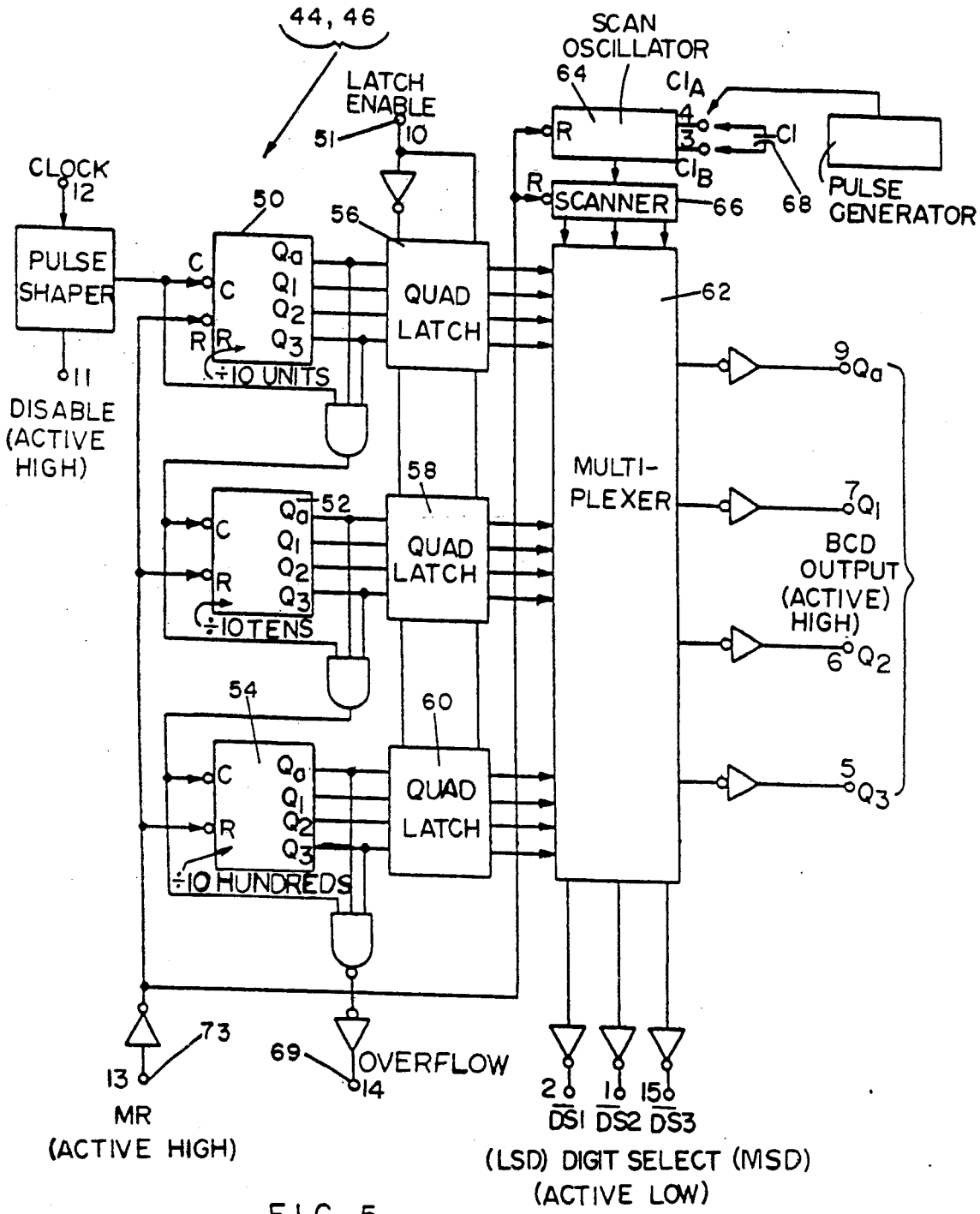
FIG. 5 is an expanded block diagram of the BCD counters shown in the block diagram of FIG. 3.

The BCD counters are three digit counters and each BCD counter (FIG. 5) includes three negative edge triggered counters 50, 52 and 54 which are cascaded in a synchronous fashion. Quad latches 56, 58 and 60 are respectively connected to the output of counters 50, 52, and 54. The quad latches permit storage of any given count. The BCD outputs (active high), after going through the latches, are time division multiplexed in multiplexer 62 providing one BCD number or digit at a time. Digit select outputs (active low) are provided for display control. An on chip scan oscillator 64 provides the low frequency scanner 66 a frequency which drives the multiplexer output selector. The frequency of the oscillator is controlled externally by a capacitor 68. An over flow output 69 provides an output every 1000 counts (1 second). This output is sent to the clock input of BCD counter 44 and to the clock input of the divide by N down counter 49 of the presetable countdown timer gate 38. The latch enable 51 of the BCD counters are active low and in this state passes the count stored in the quad latches 56, 58 and 60 on to the multiplexer. When the latch enable 51 is high the quad latches 56, 58 and 60 will store the incoming clock pulses from counters 50, 52 and 54. The master reset (MR) 73 is active high and in this position resets the whole process. The master reset when taken high initializes the three counters 50, 52 and 54 and the multiplexer scanning circuit and resets the digit scanner circuit and resets the digit scanner 66 to digit one and the scan oscillator 64 is inhibited. Two BCD counters 44 and 46 are used in the five digit display of the device of the present invention.

The presetable countdown timer gate circuit is preset for operation on a particular track and the countdown is started upon the first stimulus (as the car passes the "start" line). A second stimulus is not allowed to pass. Accordingly, any false triggers are eliminated between the first and a second stimulus. Such false triggers may be additional markers on or near the race course that may produce an erroneous signal (stimulus).

In operation, the operator (who knows approximately the fastest time his car will traverse the course) sets the BCD switches 43 and 45 for a time duration slightly less than the anticipated time that it will take to traverse the race course, before commencing a traverse around the course. For example, if the operator anticipates that it will take 12.00 seconds for a traverse, he sets the first BCD switch 43 (MSD) to "1" and the next BCD switch 45 (LSD) to "2" thus giving him a countdown time of 12.000 seconds.

Figure 10:
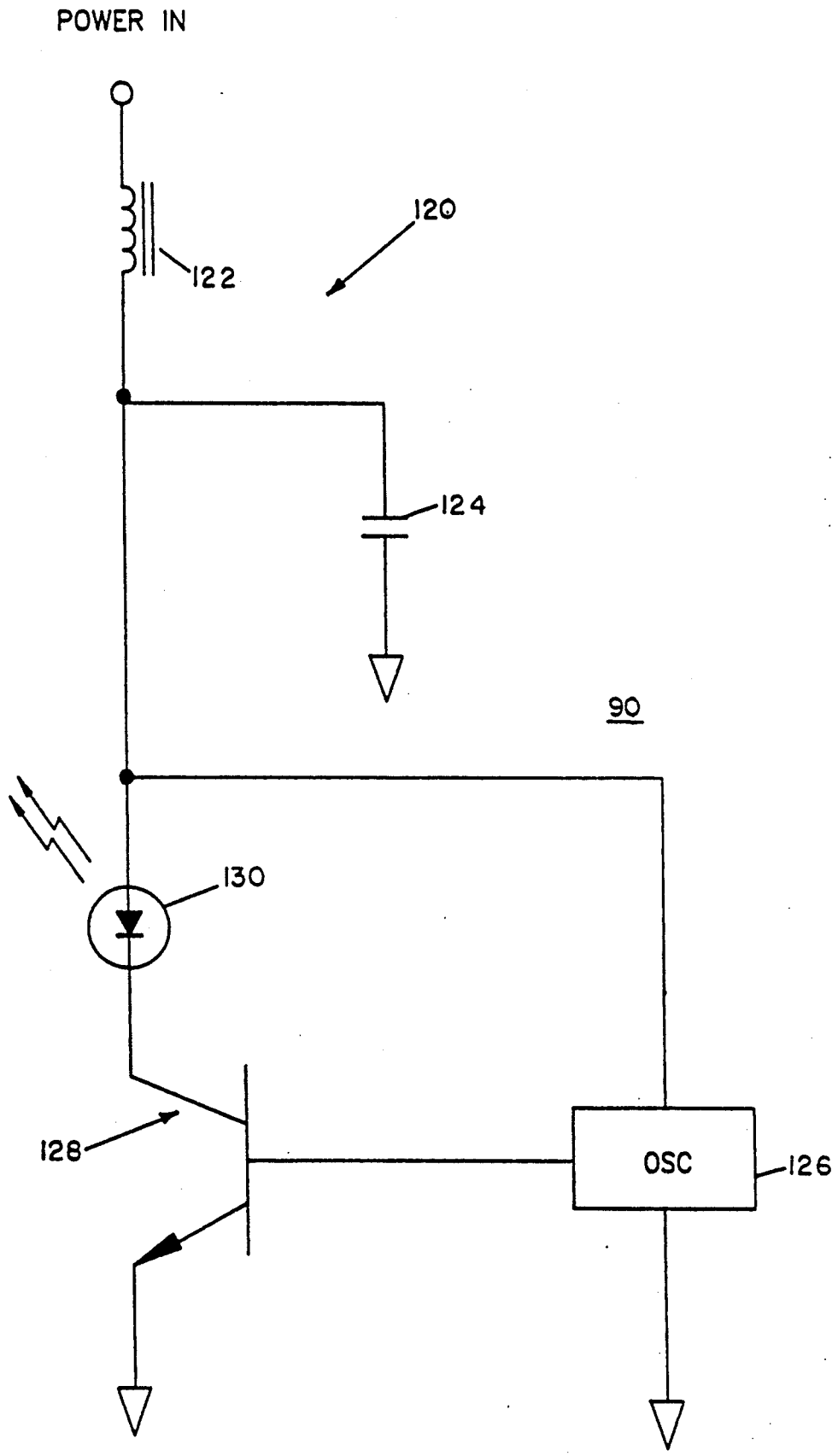
FIG. 10 is a schematic view of a optical transmitter used for triggering the optical detector of FIGS. 8 and 9.

In the embodiment shown, an initial impulse is generated by the detector 22 when the car passes over the start line. This signal is initiated by a transmitter 90 (FIG. 10). The transmitter transmits a signal which is returned (reflected) by the start line marker to a receiver circuit 92 (FIG. 8) of the detector 22. The signal from the receiver is passed through filter 24 where unwanted frequencies are filtered out (FIG. 3) and to comparator 26 where it is compared with a preset voltage level and, if conditions are acceptable, this signal is passed on to the presettable countdown timer gate circuit 38.

This first stimulus is received by a multivibrator 39 set up as a one-shot and connected in the circuit in a retriggerable manner. One shot multivibrator 39 passes the signal information to a second one-shot multivibrator 40 which is connected in the circuit in a non-retriggerable manner, and the second one-shot multivibrator 40 passes this signal information to the latch enable inputs 51 of BCD counters 44 and 46. This signal is also passed to a third one-shot multivibrator 41 (which is set up in a non-retriggerable fashion) and also to a fourth one-shot multivibrator 42 which is also set up in a non-retriggerable manner. Multivibrator 42 provides a short delay type less than one millisecond and then passes this signal to the reset inputs of BCD counters #44 and 46. The third one-shot multivibrator 41 passes the signal to the master-reset 75 of the two down counters 47 and 49 (divide by N down counters). This starts the countdown timer process. A second stimulus will not be allowed to pass to the BCD counters 44 and 46 (FIGS. 3 and 5) until the preset countdown time period has been completed.

Figure 6:
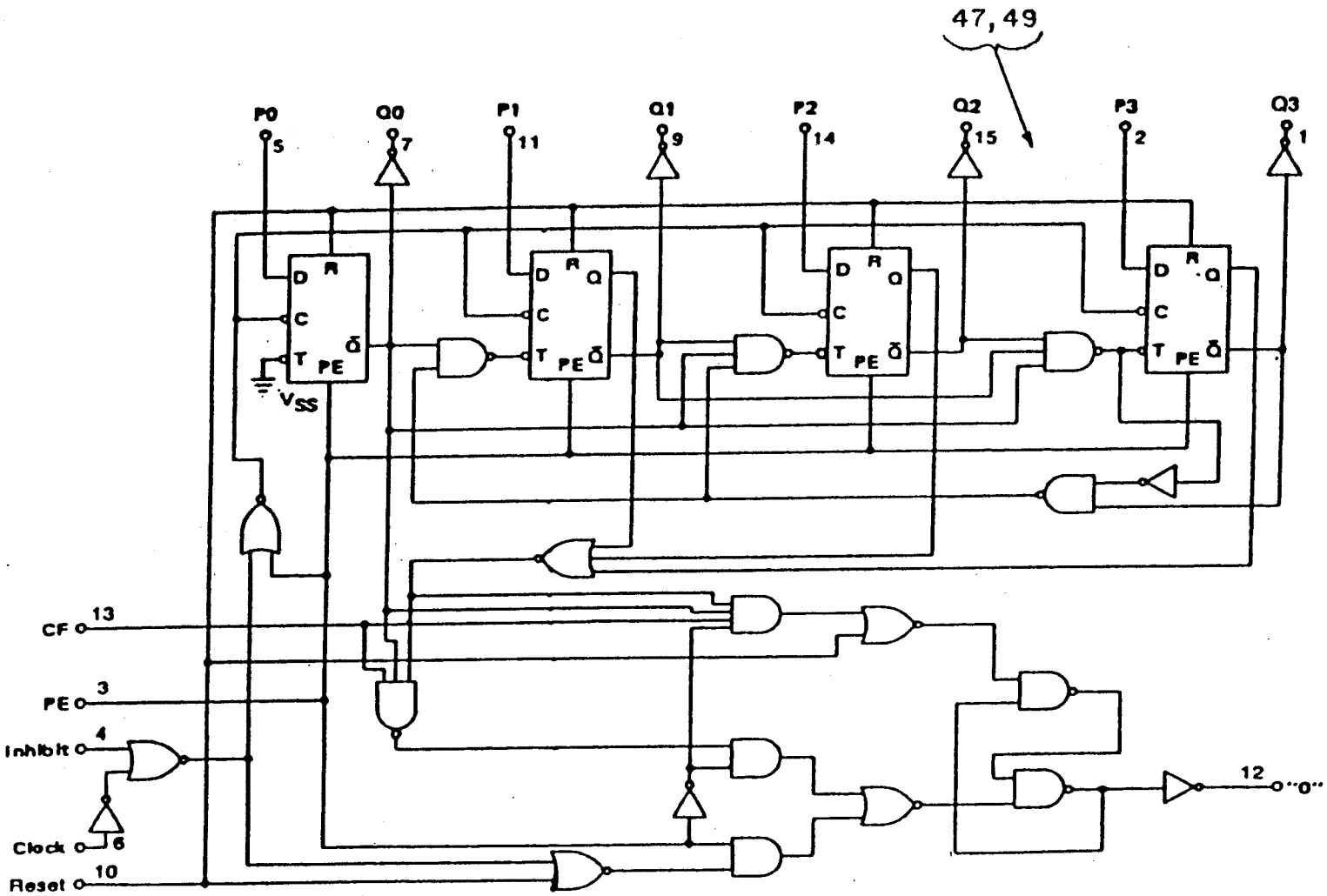
FIG. 6 is a logic diagram of the countdown timers shown in the block diagram of FIG. 3.

Clock 48, meanwhile, provides BCD counter 46 a clock pulse of 1000 cycles per second and BCD counter 46 also provides BCD counter 44 and the clock input of the divide by N down counter 49 an overflow clock pulse every one second. This information is stored in the quad latches of both BCD counters. After the preset countdown time condition has been met, the divide by N downcounters 47 and 49 (FIGS. 3 and 6) produce a pulse to the first one-shot multivibrator 39 and will allow it to pass a second stimulus. The car then passes over the finish line (or the next predetermined marker) and this second stimulus is allowed to activate the latch enable inputs and reset inputs of the BCD counters to allow the BCD counters 44 and 46 to pass the clock information that has been stored in the quad latches onto the multiplexer outputs of the BCD counters and on to display drivers 63 and 65 to drive the display 67. This process permits the use of only a single display to accurately time consecutive laps or events.

Such display drivers are well known in the art. One such device, as may be used in the present invention is identified as Motorola part number 14511 and is disclosed in pages 7-387 of Motorola catalog entitled "Motorola CM05 Data", Series C, 1978.

As seen in FIG. 3, a manual push-to-enable switch 61 may be provided, if desired, to allow the operator of the vehicle to manually enable the countdown timers to detect any stimulus. This allows the timing of the distance between any two markers on the race course without having to preset the BCD switches 43 and 45.

Figure 4:
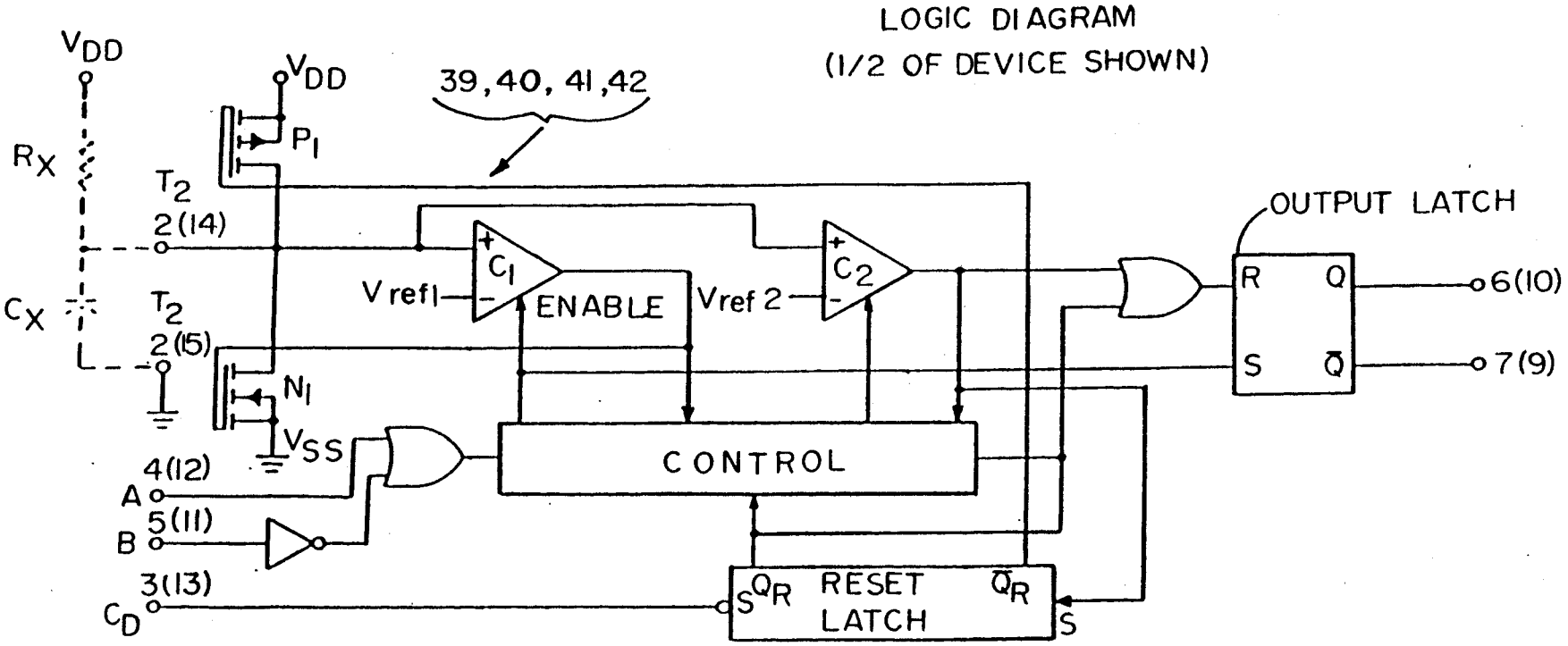
FIG. 4 is a logic diagram of the multivibrators shown in the block diagram of FIG. 3.

Although FIG. 3 illustrates four one-shot multivibrators in circuit it is to be understood that the system actually uses both halves of two dual precision monostable multivibrators to form the four one-shots. Such multivibrators are well known in the art. FIG. 4 illustrates one half of a multivibrator which may be used in the present invention and is manufactured by Motorola as part number MC14538B. The multivibrators are disclosed in pages 6-367 thru 6-374 of Motorola Catalog entitled "CM05 Logic Data", Series A, 1985. The BCD counters used herein may be similar to those shown in FIG. 5 which is an expanded block diagram of a BCD counter manufactured by Motorola, Inc. and identified as part number MC14553B. The BCD counter is described and illustrated in pages 6-398 thru 6-403 of Motorola catalog entitled "CM05 Logic Data", Series A, 1985. The divide by N down counters may be similar to those shown in FIG. 6 which illustrates a BCD down counter logic diagram of a BCD down counter manufactured by Motorola, Inc. and identified as part number MC 14522B. These downcounters are described and illustrated on pages 6-309 through 6-316 of Motorola catalog entitled "CM05 Logic Data", Series A, 1985.

Figure 7:
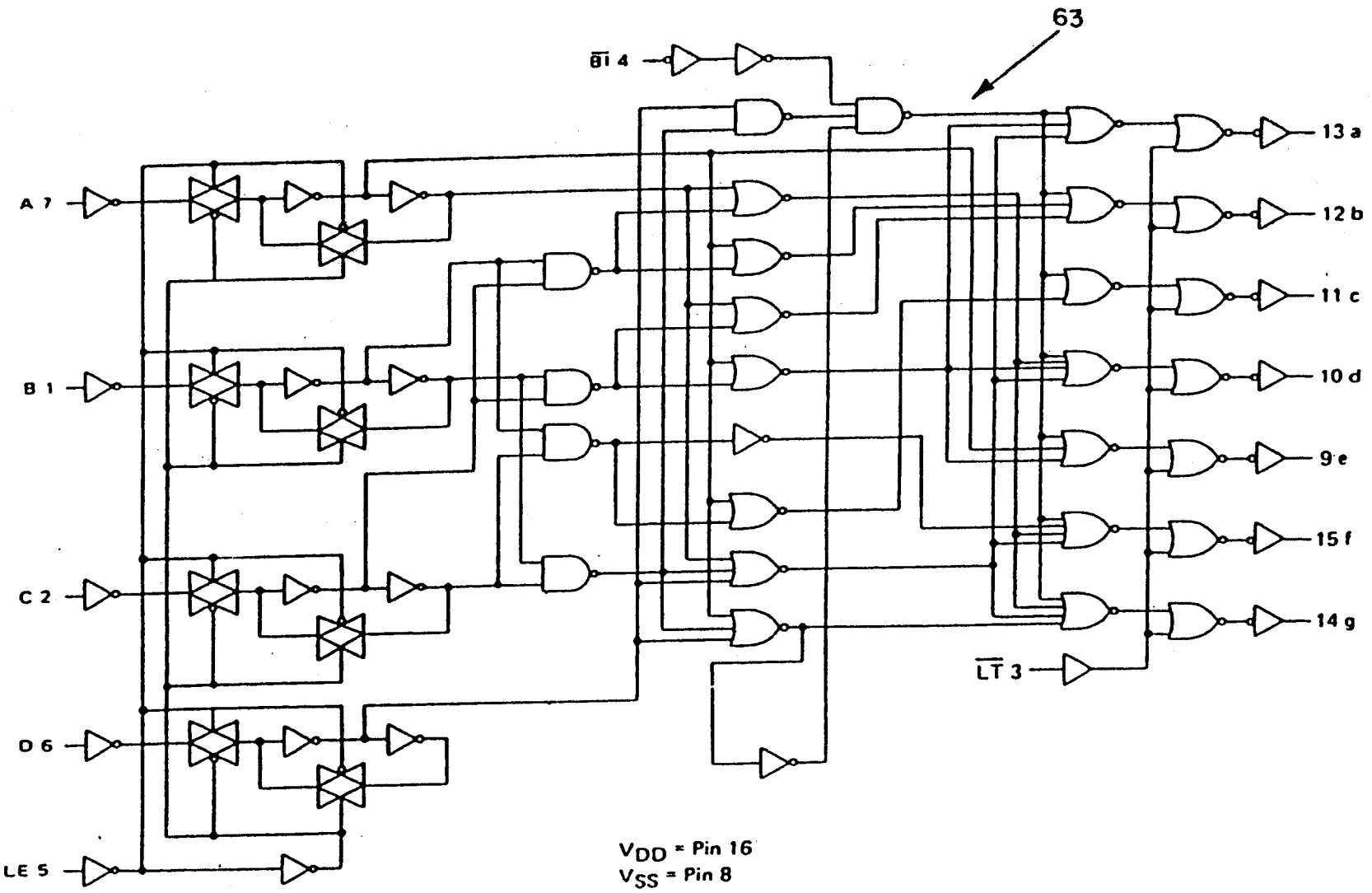
FIG. 7 is a logic diagram of the display drivers shown in the block diagram of FIG. 3.

The BCD switches 43 and 45 may be similar to those shown in FIG. 7 manufactured by AMP, Inc. and identified as part number 54778-1. Such a switch is disclosed on page 13 of AMP catalog number 86-777 (1989) entitled "Printed Circuit Board Switches and Shunts".

Figure 8:
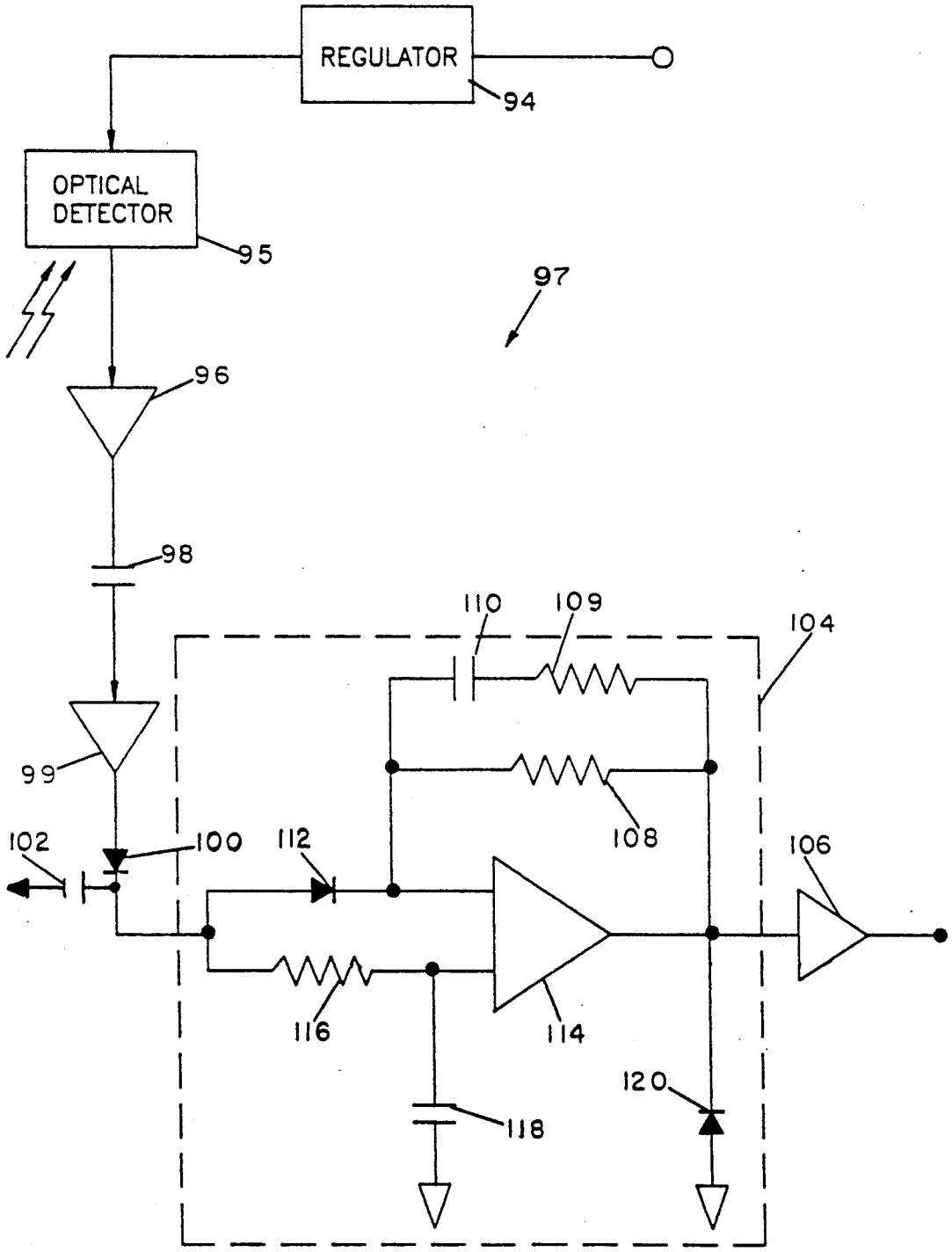
FIG. 8 is a schematic diagram of one embodiment of an optical detector circuit which may be used with the timing and display system of the present invention.
Figure 9:
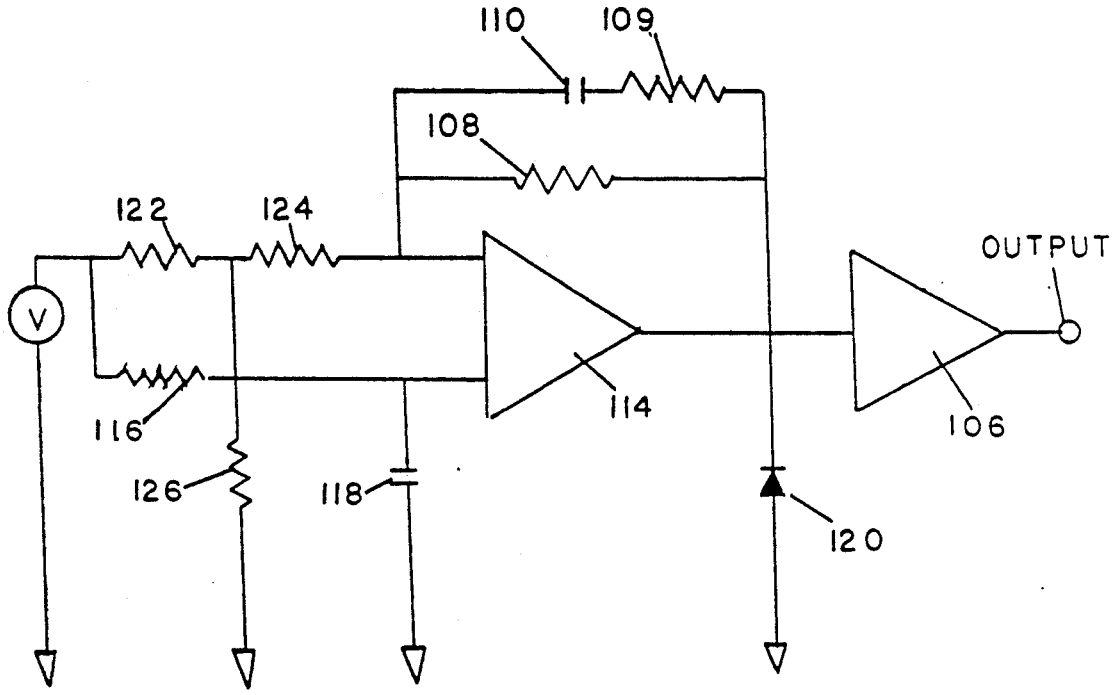
FIG. 9 is a schematic diagram of another comparator circuit of the optical detector shown in FIG. 8.

Optical detector 22 may be comprised of optical transmitter and detection circuits as illustrated in FIGS. 8 and 9 which are respectively shown to include optical transmitter circuit 90 (FIG. 10) and an optical receiver circuit 92 (FIG. 8). receiver circuit 92 includes a voltage regulator 94 which precisely regulates the voltage received from a source of power. This DC voltage is regulated by regulator 94 and passed on to an optical detector 95 and the varying output from detector 95 is amplified by amplifier 96. The output from amplifier 96 is AC coupled by AC coupling capacitor 98 where the low frequency and DC components are removed. This AC signal is then amplified by amplifier 99 and is then rectified by diode 100 and smoothed by capacitor 102 to become a varying DC signal. This DC signal is fed to a fast event detector circuit 104. Circuit 104 includes an amplifier 114 which will ignore a slow changing signal and will change state only if it sees an incoming signal of the proper speed. The output of the detector circuit 104 is fed to an output amplifier 106 which is then fed to the timing circuitry of FIG. 3. A feedback resistor 108 and capacitor 110 control hysteresis. A resistor 109 can be provided in series with capacitor 110 to limit the energy that capacitor 110 sees. A diode 120 controls the feedback voltage level at the input junction node and resistor 108. The optical detector is a comparator circuit whose output state is dependent on comparison of the voltage levels of the noninverting and inverting inputs to an amplifier 114. By biasing one input of the amplifier 114 at a slightly lower voltage than the other input with a voltage dropping diode 112 and by controlling the rate of change of the other input with an RC circuit comprised of a resistor 116 and a capacitor 118 the output state of the amplifier will change state only if the input signal changes at a rapid enough rate.

With the incorporation of this circuit the optical detector does not need a sensitivity control which has been generally found (from experience) to be user unfriendly to the average race car driver. This circuit also helps to keep the optical detector from falsely triggering if the asphalt contrast changes. Some typical component valves of the circuits illustrated in FIGS. 8 are as follows:

112—diode
120—single diode to a zener diode (voltage clamp)
122—100 ohm—1 meg. ohm
124—100 ohm—1 meg. ohm
126—100 ohm—1 meg. ohms
116—100 ohm—1 meg. ohm
108—1000 ohm—10 meg. ohm
118 and 110—100 pF—1uFd
114—Typical opamp. or comparator Optical detectors and transmitters are well known in the art. One such type device is disclosed in U.S. Pat. No. 3,160,463, issued Dec. 8, 1964, to F. Moscarini, entitled "Device For Taking And Recording The Performance Data Of A Running Motor Vehicle".

The optical transmitter circuit 90 is shown in FIG. 10 to include an input filter 120 comprised of an inductor 122 and a smoothing capacitor 124. Power is received from the vehicle battery or a separate battery. The power is filtered and sent to an oscillator 126 which is connected to the base of a power transistor 128 which drives an optical diode transmitter 130. The optical output of the optical diode 130 is reflected off of the line or marker on the race course and is received by detector circuit 92.

The timing and display circuitry is mounted in housing 20 as shown in FIG. 2 which also illustrates the housing 20 as having an access 23 through which the pair of BCD switches 43 and 45 are adjusted. The switches are adjusted for each track (course) on which the vehicle will race. Typically two BCD switches are used and are adjustable, for example, through ranges of 1 to 10 with the first BCD switch 43 being adjustable for a predetermined time interval (minutes, for example) and the second BCD switch 45 being adjustable for another predetermined time interval (seconds, for example). Or,if desired, the first BCD switch 43 may be adjustable in ten (10) second periods, and the second BCD switch 45 in second periods, etc. In any event, it is first determined the time that it is anticipated that it will take to traverse the distance between selected markers and the BCD switches are set to operate for a time period just short of the anticipated time.

FIG. 9 illustrates another embodiment of the circuit shown in FIG. 8 wherein like reference numerals refer to like parts. In this embodiment, all the components of the embodiment of FIG. 8 remain except that diode 112 has been replaced by a pair of series connected resistors 122 and 124 and with a third resistor 126 connected between resistors 122 and 124 and ground.

It is to be understood that the detector 22 may be any of many types of devices for sensing when a marker secured on the course has been detected. A magnetic sensor such as disclosed in U.S. Pat. No. 4,392,122 may be used if the marker were a magnetic strip secured to the course. Or, if desired,many other types of detectors may be used in practicing my invention, such as, for example, radio frequency (RF) devices wherein a RF field is transmitted and detected; chemical detectors for detecting a specific chemical applied to the track; radioactive detectors for detecting a radioactive substance placed on the track; or reflected, electromagnetic field detectors wherein an electromagnetic filed is produced and detected at some location on the track; and an electromagnetic field null type detector for detecting the null of an electromagnetic field.

It should be understood that housing 20 is provided with access 23 to permit adjustment of the BCD switches for the particular race track the vehicle is to run on.

It is to be further understood that the timer mechanism of the present invention is not limited to an oval track, but may be used on a straight-away track, a figure 8 track or a track of any configuration.

While the above description constitutes a preferred embodiment of the present invention, it will be appreciated that the invention is susceptible to modification, variation and change without departing from the proper scope and fair meaning of the accompanying claims.

I claim:

1. A system for on-board timing for a race vehicle traversing a race course having indicator means thereon for indicating predetermined points along said course, including a start and stop indicator, said indicator means including undesirable extraneous markers placed between said start and stop indicators, said system comprising sensing means disposed on said vehicle for producing an electrical actuation signal in response to sensing each said indicator means;

on board timing circuit means responsive to said sensing means to record the time interval said start and stop indicators produced by said sensing means as said vehicle passes said start and stop indicators, said on-board timing means including presettable countdown circuit means for counting down from an initial preset time, which is slightly less than an estimated time for traversing said course, to a final actual time that it takes to traverse said course, said countdown circuit means further including circuit means responsive to sensor signals generated at said start indicator to actuate said countdown circuit means and to prevent stimuli from said extraneous markers from reaching said timing circuit means until said preset countdown time has elapsed, said preset time period being on-board, operator adjustable to accommodate tracker having different distances between start and stop indicators; and on board display means responsive to said timing means for displaying the elapsed time between said start and stop indicators of the immediate preceding lap simultaneously while said timing means is recording the time it is taking to traverse the lap being traversed.

2. A system as set forth in claim 1 including a comparator connected to said sensor and to a reference signal for receiving and comparing signals from said sensor and said reference signal.

3. A system as set forth in claim 2 wherein said timing circuit means is electrically connected to said comparator for receiving said actuation signal therefrom.

4. A system as set forth in claim 3 wherein said timing circuit means includes multivibrator means connected to said comparator to receive electrical signals and divide by N downcounter means electrically connected to said multivibrator means for receiving electrical signals therefrom.

5. A system as set forth in claim 4 wherein said timing circuit means includes a plurality of adjustable members for presetting said estimated time, said adjustable members being electrically connected to said downcounter means adjustable in individual ranges with the range of one adjustable member being additive to the range of the succeeding adjustable member.

6. A system as set forth in claim 5 wherein said timing means includes clock means for providing an output signal to said display means.

7. A system as set forth in claim 6 wherein said sensing means is a sensor mounted on said vehicle to sense when said vehicle passes a said indicator.

8. A system as set forth in claim 7 including BCD counter means connected to said multivibrator means for receiving electrical signals therefrom and for providing an output signal.

9. A system as set forth in claim 8 including display driver means electrically connected to said BCD means to receiving electrical signals therefrom for driving said display means.

10. A system as set forth in claim 1 wherein said display means is a single display unit.

11. A system as set forth in claim 9 wherein said single display unit is a seven segment display unit.

12. A system as set forth in claim 9 wherein said indicators are provided with light reflective surfaces and said sensing means includes a photoreceptive transducer for receiving the reflected light and converting said light into electrical signals.

13. A system for on-board timing for an automotive vehicle traversing a racing track having stop and start indicators attached thereon, said track further having extraneous markers attached thereon between said start and stop indicators which serve as lane lines or distance markers, said system comprising:

sensing means disposed on said vehicle for producing start and stop electrical actuation signals respectively indicative of and in response to the sensing of said start and stop indicators responsive to said vehicle passing said start and stop indicators;

on board timing circuit means responsive to said sensing means to record the time interval between said first and second electrical actuation signals, said on-board timing means including a presettable, adjustable countdown circuit means for counting down from an initial preset time, which is slightly less than an estimated time for traversing said race track, to a final actual time that it takes to traverse said course;

circuit means for preventing actuation of said presettable countdown circuit means by said extraneous markers;

recording and storage means for recording and storing the time for said vehicle to pass said start and stop indicators; and on-board display means disposed for actuation by said start actuation signal to display the time it took to traverse the previous lap while said timing circuit is timing the present lap and said recording and storage means is recording and storing the present lap information for subsequent display.

14. A system as set forth in claim 13 wherein said indicators are provided with light reflective surfaces and said sensing means includes a photoreceptive transducer for receiving said reflected light and converting said light into electrical signals.

* * * * *